US005099891A

United States Patent [19]

Hiramatsu

[11] Patent Number: 5,099,891

[45] Date of Patent: Mar. 31, 1992

[54] SHED-FORMING MECHANISM FOR A CIRCULAR LOOM

[75] Inventor: Satoru Hiramatsu, Kyoto, Japan

[73] Assignee: Torii Winding Machine Co., Ltd., Kyoto, Japan

[21] Appl. No.: 517,138

[22] Filed: May 1, 1990

[30] Foreign Application Priority Data

May 2, 1989 [JP] Japan ..... 1-113488

[51] Int. Cl.[5] ..... D03D 37/00; D03C 13/00

[52] U.S. Cl. ..... 139/457

[58] Field of Search ..... 139/457, 458, 459

[56] References Cited

U.S. PATENT DOCUMENTS 2,671,472 6/1952 Low .
4,316,488 2/1982 Manini .
4,424,836 1/1984 Torii .

FOREIGN PATENT DOCUMENTS 49948 6/1889 Fed. Rep. of Germany .
350032 2/1922 Fed. Rep. of Germany .
593110 2/1934 Fed. Rep. of Germany .
2047756 12/1980 United Kingdom ..... 139/458

*Primary Examiner*—Andrew M. Falik
*Attorney, Agent, or Firm*—Armstrong, Nikaido, Marmelstein, Kubovcik & Murray

[57] ABSTRACT

In a circular loom provided with a main drive shaft, a plurality of healds are arranged in a ring-shaped alignment coaxially around the main drive shaft. An annular reed member is stationarily located inside the ring-shaped alignment of the healds and coaxially therearound, wherein shuttles are able to move along an annular passage defined by the annular reed member, a weft taken out from each of the shuttles is inserted to successive sheds created by a shed-forming mechanism and the inserted weft is interwoven with the warps to form a tubular fabric having a predetermined weave structure, by applying a particular shed forming mechanism based upon a principle such that the shedding operations of a unit group of warps to create each one repeat weave structure is controlled to satisfy the crossing condition between said warps and said inserted weft which is defined by said one repeat weave structure.

4 Claims, 8 Drawing Sheets

SHED-FORMING MECHANISM FOR A CIRCULAR LOOM

BACKGROUND OF THE INVENTION

1. Field of the Invention

The present invention relates to a shed forming mechanism applied to a circular loom, more particularly, to a shed-forming mechanism applied to a circular loom for producing a tubular fabric having a satin weave structure.

2. Description of the Related Art

In a conventional circular loom, shuttles are moved along a circular running passage, a weft taken out from each shuttle is inserted to successive sheds created before the arrival of the shuttle, and the weft is interwoven with warps to form a tubular fabric, as disclosed by U.S. Pat. No. 4,424,836. The conventional circular loom of this type has been designed only to produce a tubular fabric having a plain weave structure, and therefore, the shed-forming mechanism is characterized by a construction for controlling the shed-forming motion of warps in such a way that each two adjacent warps move in opposite directions respectively, in each shed formation to create the plain weave structure.

Recently, the market for tubular fabrics in industrial use has expanded due to its high extensibility if used in a bias. Further, research by the present inventors confirmed that, if a satin weave structure is applied to the tubular fabric, this extensibility is greatly improved. Nevertheless, the conventional circular loom cannot be used to produce a tubular fabric having a satin weave structure, because the shed-forming mechanism of the conventional circular loom is designed to produce a tubular fabric having a plain weave structure, as mentioned above.

Therefore, a primary object of the present invention is to provide a circular loom by which the motion of the warps is controlled in such a manner that the shed-forming motion of the warps follows the one repeat of the basic structure of a desired satin weave structure.

SUMMARY OF THE INVENTION

To attain the above-mentioned object, according to the present invention, the shed-forming mechanism of the conventional circular loom is replaced by a specially designed shed-forming mechanism which is characterized by including a mechanism by which the shed forming motion of a successively adjacent warps is controlled, in a condition defined by the one repeat weave structure, wherein the number of these warps is identical to the number of warps of the one repeat weave structure. Therefore, all of the warps applied to the circular loom are successively divided into a plurality of groups of warps, the number of warps of each group being identical to the number of warps on one repeat weave structure, and a plurality of unit mechanisms for controlling the shed-forming motion of the warps in each group are successively mounted on the circular loom.

BRIEF EXPLANATION OF THE DRAWINGS

FIG. 8 is an explanatory view showing the basic technical concept of controlling the shed-forming motion of the warps of a unit group based upon the number of warps needed to construct the one repeat weave structure of eight healds satin weave structure;

FIG. 9 is a schematic side view of the second embodiment of the shed forming mechanism applied to the circular loom, similar to the first embodiment of the present invention; and, FIG. 10 is a view of the third embodiment of the shed-forming mechanism applied to the circular loom, similar to the first embodiment of the present invention.

DESCRIPTION OF THE PREFERRED EMBODIMENTS

Figure 1:
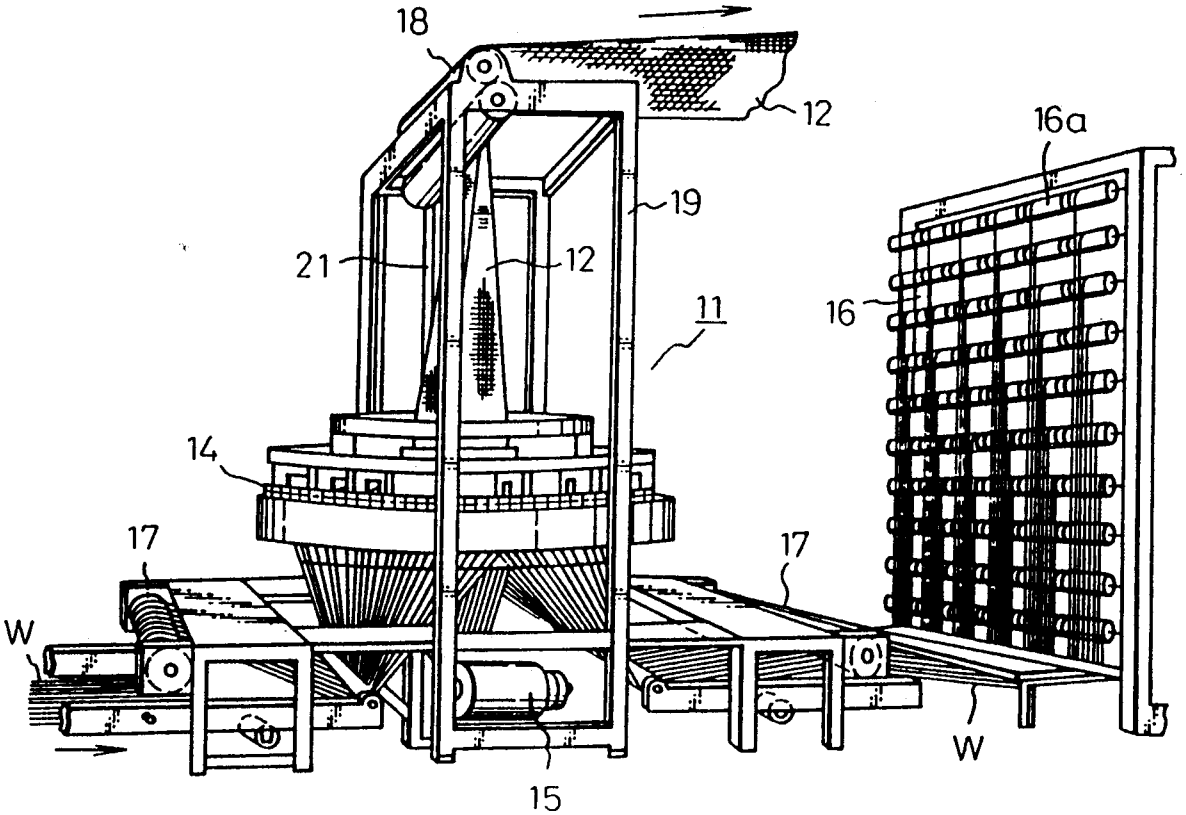
FIG. 1 is a schematic perspective view of a conventional circular loom to which the present invention can be applied.

Before explaining the preferred embodiments of the present invention, to facilitate an easy understanding of the present invention, the mechanism and the function of the conventional circular loom are briefly explained with reference to FIGS. 1, 2, and 3.

In the circular loom 11 shown in FIG. 1, a main part 14 including a shed-forming means and filling means is mounted within a frame 19; the shed forming means and filling means being driven by an electric motor 15 mounted below the main part 14, through a first power transmission mechanism (not shown). A tubular fabric take-out means 18 mounted on the frame 19 above the main part 14 is driven by a second power transmission mechanism (not shown) connected to the take-out means 18. This second power transmission mechanism is driven by the first power transmission mechanism through a drive transmission lever 21, and thus the take-out means 18 is driven synchronously with the main part 14. A number of warps w for weaving a required tubular fabric 12 are fed to a pair of creels 16 arranged symmetrically to each other on both sides of the main part 14, with respect to the main part 14 (only one creel arranged on the right side is illustrated FIG. 1), from a plurality of packages **16*a*, mounted rotatably for feeding the warps w, and the warps w are fed to the main part 14 through a warp feed mechanism 17. The tubular fabric 12 formed by a weaving operation in the main part 14 of the circular loom 11 is taken out upwardly by the take-out means 18** and guided to a winding means (not shown) in the direction indicated by an arrow.

Figure 2:
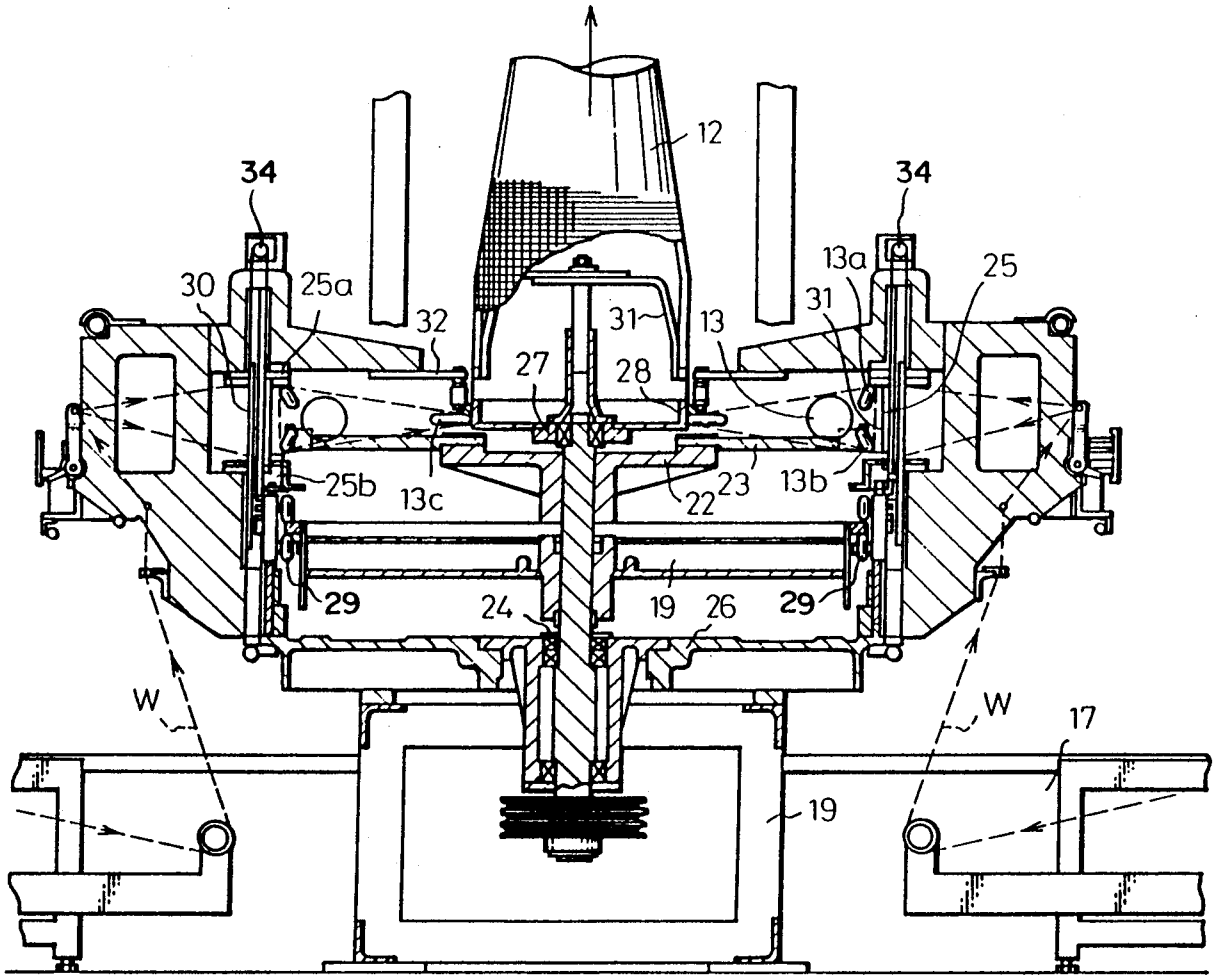
FIG. 2 is a schematic sectional view of the main part of the conventional circular loom shown in FIG. 1.

As shown in FIGS. 1 and 2, the main part 14 of the circular loom 11 is provided with a vertical shaft 24 rotatably supported on bearings fixed to a central opening of a supporting frame 26 secured to the frame 19, a cylindrical cam mechanism 29 fixed to the shaft 24 at a position above the supporting frame 26, a shed-forming mechanism 30 which is operated by the cylindrical cam mechanism 29, four shuttle propelling mechanisms 23 fixed to a supporting mechanism 22 fixed to the shaft 24 at a position above the cylindrical cam mechanism 29, an annular reed member 25 comprising a pair of ring-shaped holding members 25*a*, 25*b* and a 30 plurality of reed elements 31 rigidly supported by the ring-shaped holding members 25*a*, 25*b* in vertical condition with an identical spacing between each two adjacent reed elements 31, a horizontal disc guide member 27 supported rotatably on the top of shaft 24 to guide another wheel 13*c* of a shuttle 13, and an annular guide 28 held by supporting arms 32 in a stationary condition, with a small clearance between the guide 28 and the top end of the annular edge of the horizontal disc guide member 27.

Figure 3:
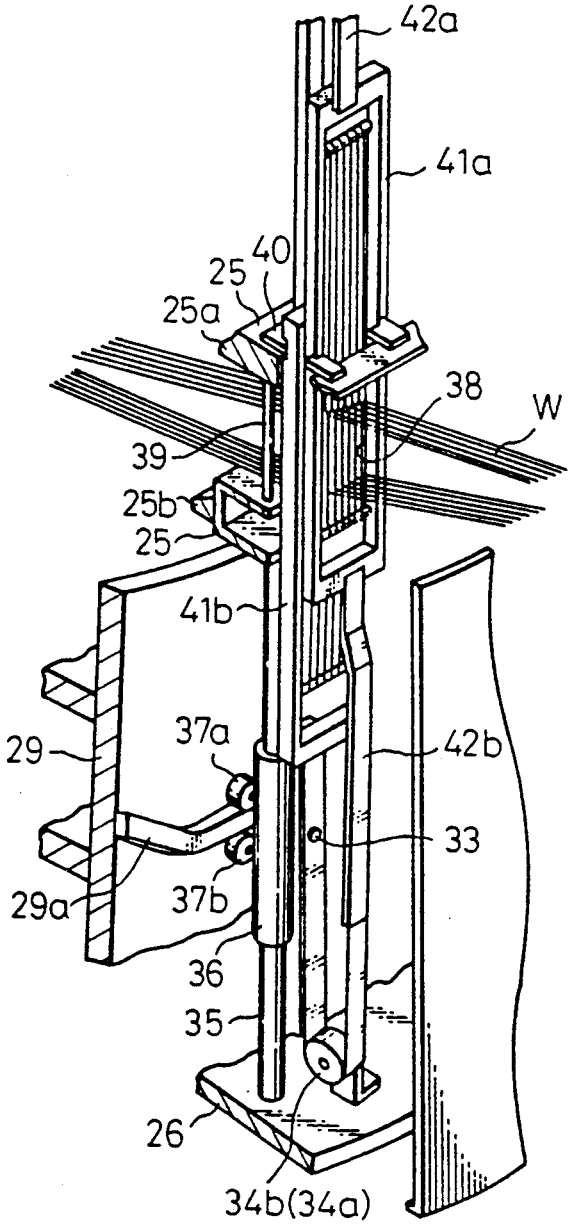
Fig. 3 PRIOR ART
FIG. 3 is a perspective schematic view showing a shed-forming mechanism of the conventional circular loom shown in FIG. 1, for producing a tubular fabric having a plain weave structure.

As shown in FIGS. 1, 2, and 3, warps w are supplied from the creels 16 at both side of the circular loom 11, and are threaded into the respective spaces between each two adjacent reed elements 31 of an annular reed member 25 rigidly supported by the ring-shaped holding members 25*a* and 25*b*, after passing through the respective eyes of corresponding healds 38 of the shed-forming mechanism 30. The shuttles 13 are propelled by the shuttle propelling mechanism 23 and inserted to the shed created by the shed-forming mechanism 30, and then a weft yarn f from the shuttle 13 is inserted to the shed by the wheel 13*c*, whereby a stable weave structure is created to form a tubular fabric 12. The tubular fabric 12 is taken out upwardly via a small annular shaped clearance formed between the horizontal guide member 27 and the outside guide member 28, and the tubular fabric 12 is then wound on a roll of a take-up mechanism (not shown).

In the above-mentioned circular loom, as shown in FIG. 3, the shed-forming means consists of a plurality of vertical guide rods 35 fixed to the peripheral flange portion of the supporting frame 26, a cam follower holding member 36 slidably mounted on the guide rods 35. an annular cam 29*a* protruded beyond the periphery of the cylindrical cam mechanism 29, a pair of cam followers 37*a*, 37*b* rotatably mounted on the holding member 36 and in rolling contact with the cam 29*a* from the upper and lower directions, heald frame guides 40 mounted on the upper annular guide member 25*a* to guide a pair of healed frames, i.e., to guide an inner heald frame 41*a* and an outer heald frame 41*b*, belts 42*a*, 42*b* connecting the two heald frames 41*a*, 41*b* so that the heald frames 41*a*, 41*b* are moved alternately in the upper and lower directions to form a shed, and belt guides 34*a*, 34*b* mounted on the peripheral flange portion of the frame 26 to guide and support the belts 42*a*, 42*b*. The holding member 36 to which the cam followers 37*a*, 37 are attached is connected to the belt 42*b* by a pin member 33, and thus a vertical movement is given to the heald frame 41*a* by the vertical movement of the holding member 36. This vertical movement is transmitted to the other heald frame 41*b* through the belts 42*a*, 42*b*, and therefore, the outer heald frame 41*b* moves up and down in a reverse direction with respect to the movement of the inner heald frame 41*a*. The heald frames 41*a*, 41*b* are each provided with an equal number of heads 38, and a number of vertical rods 39 corresponding to the number of healds 38, which are firmly positioned to form a vertically oriented grid between the upper and lower opposing guide member 25. The shape of the cam surface of the protruded annular cam 29*a* is designed with respect to the heald frames 41*a*, 41*b* in such a manner that a full-open shed is formed. By alternately passing the adjacent warps w through the mails of the healds 38, a shed constituting a plain weave fabric can be formed by rotating the cylindrical cam mechanism 29. Since a plurality heald frames 41*a*, 41*b* are periphery of the cylindrical cam mechanism 29. the pairs of heald frames 41*a*, 41*b* successively form sheds having an identical shape, in accordance with the rotation of the horizontal cylindrical cam mechanism 29, and accordingly, a plain weave tubular fabric 12 can be produced by propelling a plurality of shuttles 13.

As mentioned above, in the conventional circular loom used to produce a tubular fabric having a plain weave structure, since the shedding motion applied to the warps w is carried out in a simple way such that two adjacent warps w always take opposite positions upon each formation of an open shed, it is sufficient to use a plurality of combinations of the two heald frames 41*a*, 41*b* which are displaced in directions opposite to each other.

Figure 4:
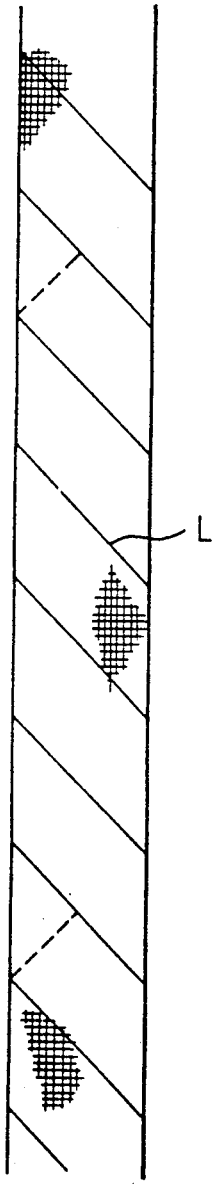
FIG. 4 is an schematic elevation view of a tubular fabric and showing a bias-cut applied thereto.

As explained above, a tubular fabric having a satin weave structure is very valuable for industrial use if the fabric is cut in a bias-cut as shown in FIG. 4, wherein the fabric is cut along a line L inclined by 45 degrees to the longitudinal direction thereof, but to produce such a tubular fabric provided with a satin weave structure, it is obvious that the shed-forming mechanism utilized in the conventional circular loom cannot be adopted.

After intensive research, the following basic technical concept was obtained, whereby the object of the present invention can be attained. During this research, consideration was given to meeting the requirements of practical use, i.e., an easy threading of the warps into the respective healds, an easy weaving operation, and no expansion of the space needed for installation of the circular loom, etc.

In view of the above considerations, the following conditions were found to be essential to the creation of the shed-forming mechanism of the present invention to be applied to a circular loom having the same mechanism as the conventional circular loom. Namely, all of the warps w are considered as a plurality of successive groups of warps w, wherein each group of warps w are successively threaded through the respective eyes of corresponding healds successively arranged coaxially to the annular reed member 25, and the number of warps w of each group coincides with the number of warps of a one repeat weave structure, i.e, one repeat satin weave structure. Further, as in the case of weaving a plain fabric by a conventional power loom, when producing a tubular fabric having a satin weave structure, it is essential that the shed-forming motions of the element warps w of each group corresponds to the arrangement of each crossing point between the element warps w and the element wefts f for forming "one repeat weave structure".

The construction and function of the shed forming mechanism according to the present invention is hereinafter explained in detail with reference to the attached drawings.

Figure 5:
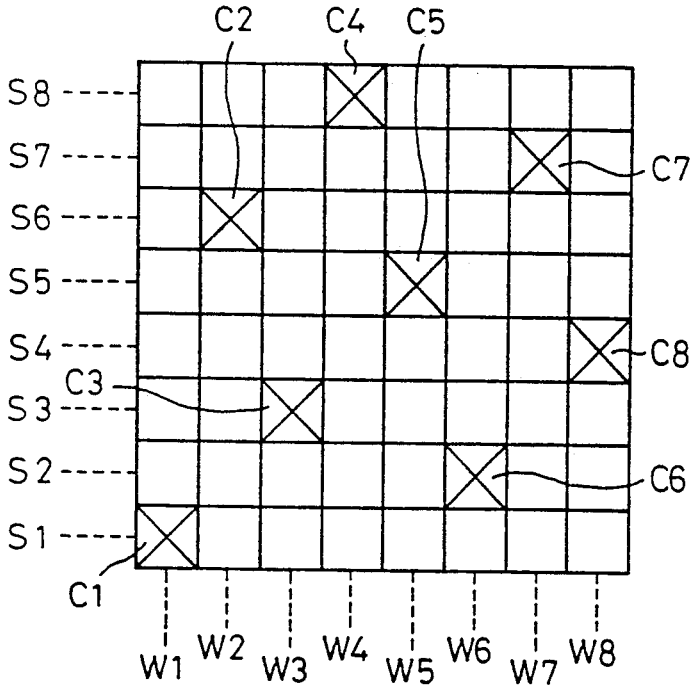
FIG. 5 shows a one repeat weave structure of eight healds satin weave structure.
Figure 6:
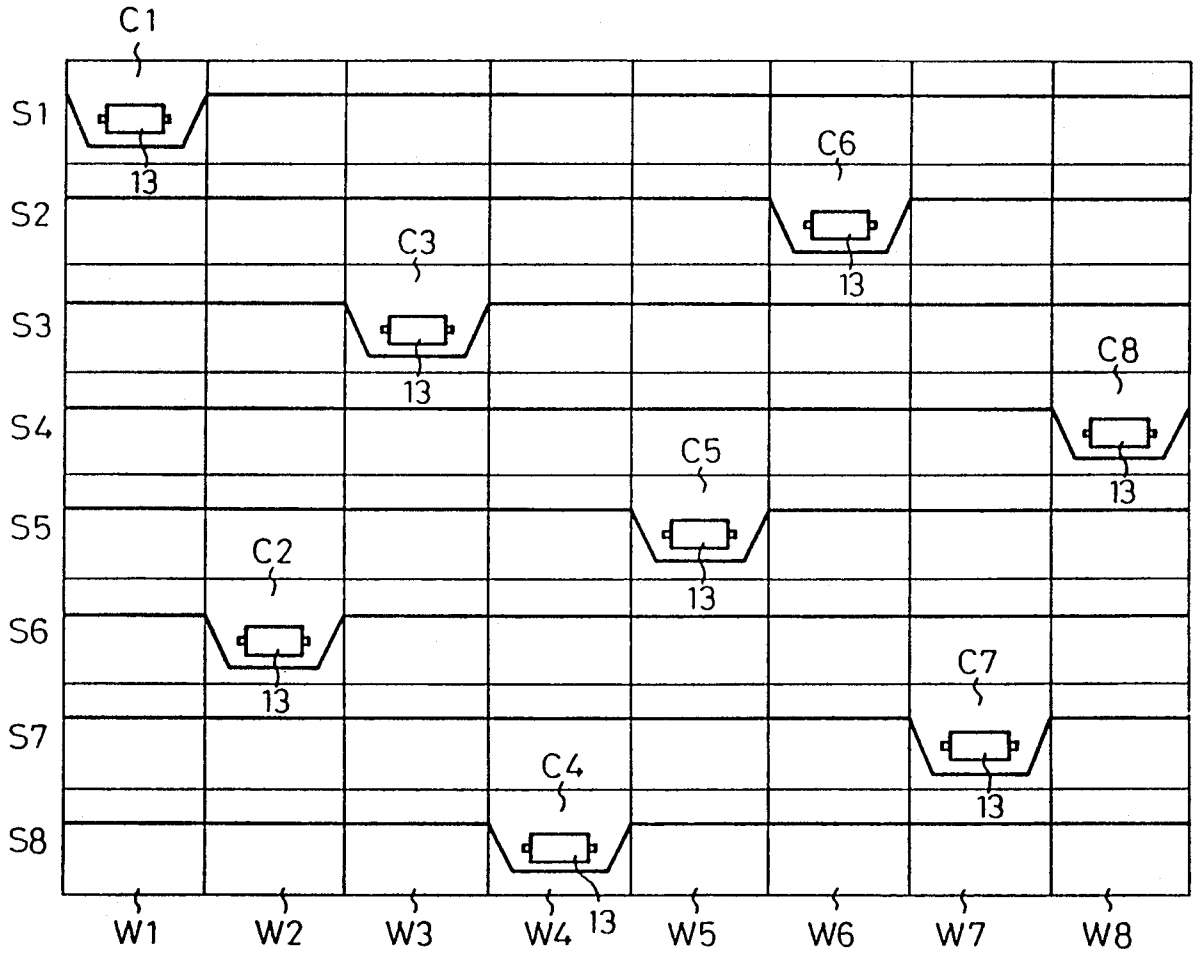
FIG. 6 is a time chart indicating the relative shed-forming motions of eight warps when creating the one repeat weave structure of eight healds satin weave structure.

FIGS. 5 and 6 show the relationship between the passage of a shuttle 13 and the position of the respective warps w, represented as w1, w2, w3, w4, w5, w6, w7, and w8, in the respective shed formations to create a one repeat weave structure of an eight healds satin weave structure, wherein each cross mark indicates a warp w which crosses a corresponding weft f in such a manner that the wrap w takes a position below the weft f. In the above mentioned shed formation s1, s2, s3, s4, s5, s6, s7, and s8, each cross mark "x" represents a condition that the shuttle 13 moves above the respective warps w, and these cross marks are identified by c1, c2, c3, c4, c5, c6, c7, and c8, respectively, as shown in FIGS. 5 and 6. This one repeat weave structure shows a lower shed system of the shed-forming motion. To facilitate an easy understanding of this shed-forming motion, the relative positions of the shuttle 13 to the warps w1, w2, w3, w4, w5, w6, w7, and w8 at each shed formation s1, s2, s3, s4, s5, s6, s7 and s8 are shown. Namely, in the first shed formation s1, the first warp w1 is moved below the passage of the shuttle 13 while the other warps w2, w3, w4, w5, w6, w7 and w8 move to standby positions above the passage of shuttle 13, respectively; in the second shed formation s2, only the sixth warp w6 is moved to a position below the passage of the shuttle 13; in the third shed formation s3, only the third warp w3 is moved to a position below the passage of the shuttle 13; in the fourth shed formation s4, only the eighth warp w8 is moved to a position below the passage of the shuttle 13; in the fifth shed formation s5, only the fifth warp w5 is moved to a position below the passage of the shuttle 13; in the sixth shed formation s6, only the second warp w2 is moved to a position below the passage of shuttle 13; in the seventh shed formation s7, only the seventh warp w7 is moved to a position below the passage of the shuttle 13; and in the eighth shed formation s8, only the fourth warp w4 is moved to a position below the passage of the shuttle 13; in the shed formations s2, s3, s4, s5, s6, s7, and s8, the other warps remain in their standby positions, respectively.

Figure 7:
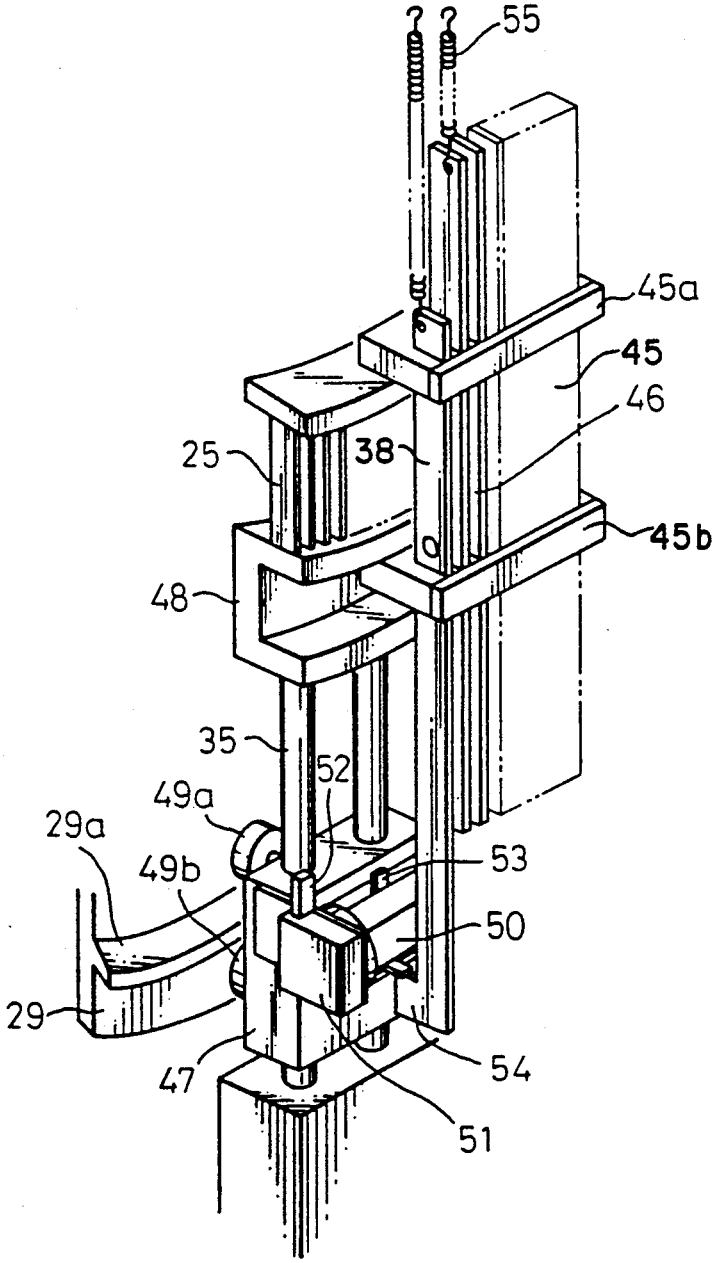
FIG. 7 is a perspective schematic view showing a first embodiment of the shed-forming mechanism applied to the circular loom in FIG. 1, and replacing the shed-forming mechanism shown in FIG. 3, according to the present invention.
Figure 7:
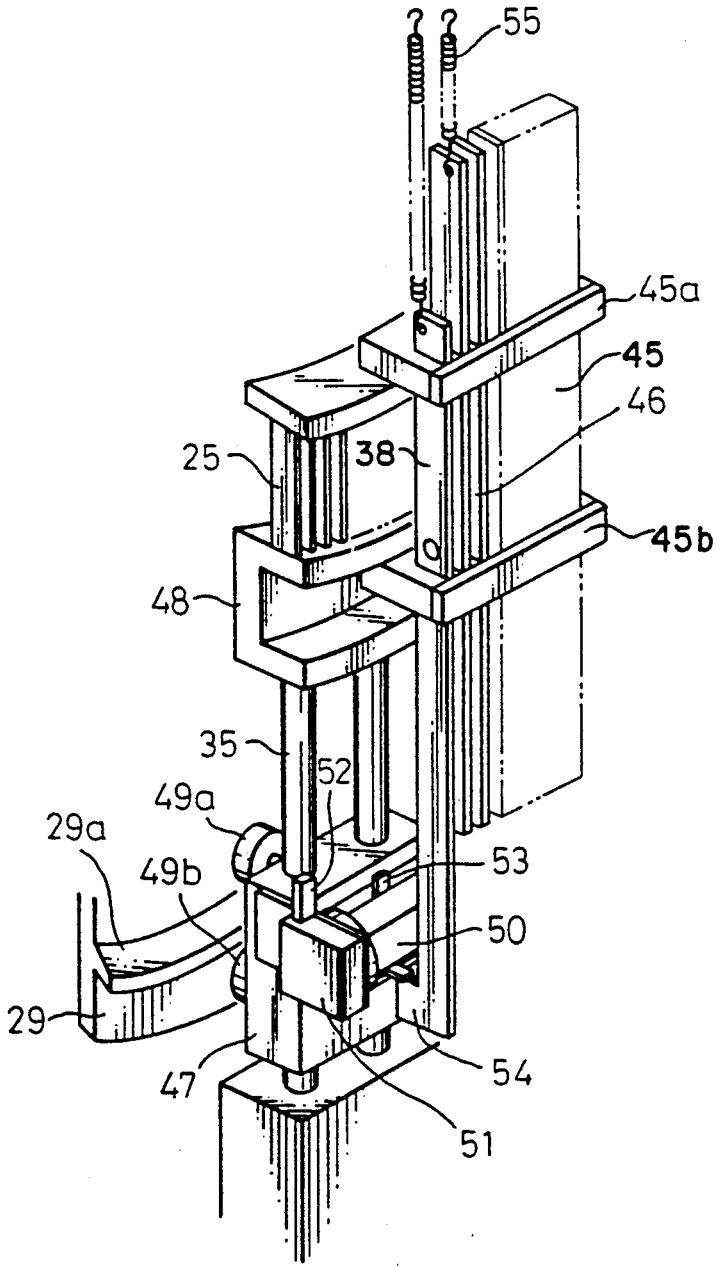

Referring to FIGS. 7 and 8, the first embodiment of the shed-forming mechanism according to the present invention is explained in detail.

As can be easily understood from the above explanation, the shed-forming mechanism is composed of a plurality of unit shed-forming mechanisms successively arranged in an alignment and coaxially to the annual reed member 25, to operate in combination with the cylindrical cam mechanism 29 in which the cam follower 29*a* protrudes beyond the periphery of the cylindrical cam mechanism 29.

Each unit shed-forming mechanism 45 comprises a group of healds 38 successively arranged in an alignment therein, a heald holding member consisting of an upper heald holder 45*a* and a lower heald holder 45*b*, which function to hold the healds 38 in an alternately upward and downward displaceable condition, and a means for selectively providing the above-mentioned upward and downward displacement of one of healds 38 each time a shed is formed. This means comprises, in combination with the cylindrical cam mechanism 29, a pair of vertical guide rods 35 fixed to the disc like frame 26, a holding member 47 supported by the vertical guide rods 35 in a capable condition of displacing upward and downward, and a horizontal annular body 48 rigidly mounted on the vertical guide rods 35 of each unit shed forming mechanism 45; the annular reed member 25 being rigidly mounted on the annular body 48 coaxially thereto. The holding member. 47 is provided with a pair of cam followers 49*a*, 49*b* having an identical function to that of the cam followers 37*a*, 37*b* of the conventional circular loom, and accordingly, the holding member 47 can be displaced upward or downward along the vertical guide rods 35. A control cylinder 50 is rotatably mounted on a horizontal shaft (not shown) supported by the holding member 47 and a ratchet wheel mechanism 51 by which the control cylinder 50 is rotated by a predetermined angle $\alpha$ at each actuation thereof, and an actuation member 52, for actuating the ratchet wheel mechanism 51, is projected upward toward the annular body 48. A predetermined number of projecting members 53 are axially projected from the cylindrical surface of the control cylinder 50 at respective positions of which each projecting member 53 can be engaged with a corresponding hook 54 formed at the bottom end of each of the healds 46. Each heald 46 is connected to helical spring 55, so that each heald 46 is always in the standby position except when the hook portion 54 of the heald 46 is pulled down by the action of the projecting member 53 of the control cylinder 50.

The annular cam 29*a* displaces the holding member 47 between a lowermost position at which the projecting member 53 displaces the corresponding hook 54 of the heald 46 to the lowermost position thereof to create a bottom open shed, and an uppermost position at which the projecting member 53 is completely separated from the engaged hook 54 after the heald 46 is returned to the standby position by the force of the spring 55.

The actuation member 52 is provided with a function such that, when the actuation member 52 is pressed by the bottom surface of the annular body 48, the actuation member 52 actuates the ratchet wheel mechanism 51 and causes it to be rotated by a predetermined angle $\alpha$, as hereinafter explained in detail.

The arrangement of the projecting members 53 is defined by the principle based upon the one repeat weave structure mentioned with reference to FIGS. 5, and 6.

The following additional explanation with reference to FIG. 8 will facilitate an understanding of this principle. In FIG. 8, since the numbers of crossing points of the warp w and the weft f in "one repeat weave structure" of an eight heald satin weave structure are eight, respectively, if a circle 50*a* which represents one rotation in the clockwise direction of a point on the cylindrical surface is divided into eight points s1, s2, s3, s4, s5, s6, s7 and s8, with an identical arc length between two adjacent points. These divided points on the circle 50*a* correspond to the timing points for forming sheds to produce a tubular fabric having an eight heald satin weave structure. Therefore, if the control cylinder 50 is rotated clockwise in FIGS. 7 and 8, each time the control cylinder 50 is rotated by the above-mentioned predetermined angle $\alpha$ (in this embodiment, $\alpha$ is 360/8 degrees=45 degrees) one of the projecting members 53 is engaged with the hook 54 of the corresponding heald 46 if the control cylinder 50 is located at a position such that the above engagement can be made, and the projecting members 53 are arranged in a condition such that the circular tracks thereof are arranged on the cylindrical surface of the control cylinder 50 at an identical spacing therebetween along the axial direction thereof, which coincides with the spacing between two hooks 54 of two adjacent healds 46. To facilitate an understanding of the above explanation, in FIG. 8 the tracks of the projecting members are represented as w1, w2, w3, w4, w5, w6, w7, and w8, respectively and the angular positions of the projecting members 53, which are selected based upon the eight healds satin weave structure, are indicated by d1, d2, d3, d4, d5, d6, d7, and d8, respectively. These angular positions correspond to the above-mentioned conditions of c1, c2, c3, c4, c5, c6, c7 and c8 shown in FIGS. 5 and 6, respectively. Therefore, the projecting members 53 arranged on the cylindrical surface of the control cylinder 50 as mentioned above are engaged one by one with one of the hooks 54 of the corresponding healds 46, due to the above arrangement of the projecting members 53 which is selected in accordance with the required weave structure (in this embodiment, an eight healds satin weave structure).

Referring to FIG. 7, the healds 46 simultaneously follow the action of the control cylinder 50 at each shed forming, and therefore, the above-mentioned control motion of the shed formation is applied to all of the unit shed forming mechanisms, whereby a tubular fabric having the desired weave structure can be produced.

The above-mentioned shed-forming motion by the shed-forming mechanism is hereinafter explained in more detail with reference to FIG. 7. During the weaving operation by the circular loom provided with the above-mentioned shed-forming mechanism, the holding member 47 of each unit shed-forming mechanism is displaced upward and downward by the action of the cylindrical cam mechanism 29. In each shed-forming mechanism, after the holding member 47 is displaced to the uppermost position thereof, when the holding member 47 is to be displaced downward, one of projecting members 53 of the control cylinder 50 is positioned at a horizontal position such that this projecting member 53 can be engaged with a hook 54 of a corresponding heald 46 (this hook is hereinafter referred to as a particular hook 54, and the heald of this particular hook 54 is referred to as a particular heald 46), while the other projecting members 53 are arranged at respective angular positions of the control cylinder 50 at which they cannot come into contact with the respective hooks 54 of the corresponding healds 46. Accordingly, when the holding member 47 is displaced downward, the above-mentioned particular hook 54 of the particular heald 46 is also displaced downward by the downward displacement of the holding member 47, because the particular hook 54 is engaged with the projecting member 53, whereby the particular heald 46 only is displaced to the lowermost position, while the other healds 46 remain at their standby positions. Accordingly, a "bottom open shed" for creating a satin weave structure is formed, and when this "bottom open shed" is formed, the shuttle 13 is successively inserted to this shed so that a unit weave structure can be created after forming the successive sheds. Since the timing at which the shuttle 13 is inserted to the shed is very important, the propelling of the shuttle along the annular reed member 25 is carried out synchronously by the rotating motion of the cylindrical cam mechanism 29, as in the conventional circular loom.

After the downward motion of the holding member 47, the holding member 47 is displaced upward by the action of the cylindrical cam mechanism 29, and the particular heald 46 is pulled upward by the force of the spring 55, while maintaining the engagement between the particular hook 54 and the corresponding projecting member 53, until the particular heald 46 arrives at the uppermost position corresponding to the standing position thereof. The above standby position is defined by providing a stopper (not shown) which is projected outward from the outside surface of each heald 46 at a particular position below the lower heald holder **45*b*, so that the upward motion of each heald 46 can be restricted by contact between the stopper and the lower holder 45*b*. The holding member 47 is further displaced upwards so that the engagement between the hook 54 and the projecting member 53 is released, and thereafter, the actuating member 52 is forced into contact with the bottom surface of the annular body 48 so that the actuating member 52 causes the ratchet wheel mechanism 51 to rotate, whereby the control cylinder 50 is rotated by the predetermined angle $\alpha$ (in this embodiment, 45 degrees). Due to this one unit rotation for $\alpha$ degrees of the control cylinder 50, the next projecting member 53, which is defined as mentioned above, comes to the working position to cause the next unit shed to weave the desired weave structure. The shed-forming motion of each unit shed-forming mechanism is thus continuously carried out by rotating the cylindrical cam mechanism 29**.

In the above embodiment, the case of producing a tubular fabric provided with an eight healds satin weave structure is explained, but if a tubular fabric having a five healds satin weave structure is required, the number of unit shed forming mechanisms, number of healds of each unit shed forming mechanism, and the number and arrangement of the projecting members 53 of the control cylinder 50 can be easily changed by applying the technical concept of the above-mentioned embodiment, and therefore, an explanation thereof is omitted.

In the second embodiment of the present invention shown in FIG. 9, the shed-forming mechanism is characterized by a modified mechanism for selecting the particular heald 46 in the weaving operation. As shown in FIG. 9, each heald 46 of the unit shed-forming mechanism is provided with a slit **46*a* formed along the lengthwise direction and at the upper portion thereof. Further, a plurality of horizontal arms 57, in a number identical to the number of healds 46 of the unit shed-forming mechanism, are extended from the annular reed member 25 in such a manner that a small shaft 57*a* secured to each horizontal arm 59 is inserted into the slit 46*a* of the corresponding heald 46 such that the heald 46 can be displaced upward and downward while able to turn about the small shaft 57*a*. The holding member 47 is provided with a horizontal recess 58 having sharp edge portion forming a hook by which the hook portion 54 of each heald 46 can be caught. A plurality of plate cams 59 are rotatably disposed above the holding member 47 at respective positions closely facing the corresponding healds 46, and a plurality of urging elements 60 provided with a pushing element utilizing a spring force are arranged to always push the respective healds 46 away from the feeding side of the warps w, so that each heald 46 is always pushed against the corresponding plate cam 59. Each plate cam 59 is provided with a means for turning by the predetermined angle $\alpha$, as explained in the description of the first embodiment of the present invention, each time the holding member 47 is reciprocally displaced upward and downward. A mechanism such as a rack and pinion, wherein the rack is actuated by the motion of the holding means, can be utilized for this invention. In this mechanism, an additional mechanism, provided with such function to rotate the plate cam 59 only at the time of either one of the above-mentioned upward and downward displacement of the holding member 47, involves. The mechanism for displacing the holding member 47 upward and downward is similar to that used in the first embodiment, and thus an explanation thereof is omitted. Each cam plate 59 is provided with a recessed portion at which the corresponding heald 46** is turned about the small shaft 57*a*, so that the hook portion 54 of the heald 46 can take a position at which it can be engaged with the hook portion formed by the recess 58. The relative arrangement of the recessed portions of the plate cams 59 of the unit shed-forming mechanism, with respect to the axial center thereof, is made on the same principle as that of the relative arrangement of the projecting members 53 of the control cylinder 50 of the first embodiment, and thus an explanation thereof is omitted.

The shed-forming motion of the second embodiment is carried out as explained hereinafter.

In the above-mentioned unit shed-forming mechanism shown in FIG. 9, the holding member 47 is once displaced downward and then reciprocally displaced upward when the actuation part of the annular cam 29*a* of the cylindrical cam mechanism 29 actuates the unit shed-forming mechanism to make a shed, which one unit of a plurality of sheds needed to construct a one repeat weave structure. If one of the cam plates 59 takes an angular position such that the recessed portion thereof faces the corresponding heald 46, this heald 46 is turned clockwise about the small shaft 57*a* (in FIG. 9), so that the hook portion 54 of the heald 46 can be engaged with one of the hook edge portions 61 of the recess 47, and accordingly, this heald 46 is displaced to the lowest position thereof by the downward displacement of the holding member 47, while the small shaft 57*a* slides in the slit of the heald 46, and thus the bottom open shed is formed. When the holding member 47 is displaced upward, the cam plate 59 is turned by the predetermined angle $\alpha$ (in this embodiment, $\alpha$ is 45 degrees), so that the recessed portion of the cam plate 59 is angularly displaced from the above-mentioned facing position, and accordingly, the heald 46, as one of the healds 46 of the unit shed-forming mechanism, is turned in the counter-clockwise direction (FIG. 9) by following the turning motion of the cam plate 59. Therefor, the hook portion 54 of the heald 46 is separated from the hook edge portion 61 of the recess 58 of the holding member 47, and then pulled upward by the force of the spring (not shown), as in the first embodiment, to the upper most position (standby position) thereof. The above-mentioned shed-forming motion is applied to all healds 46 of the unit shed-forming mechanism in the same way as in the first embodiment, so that a one repeat weave structure of the desired tubular fabric is formed.

Figure 10:
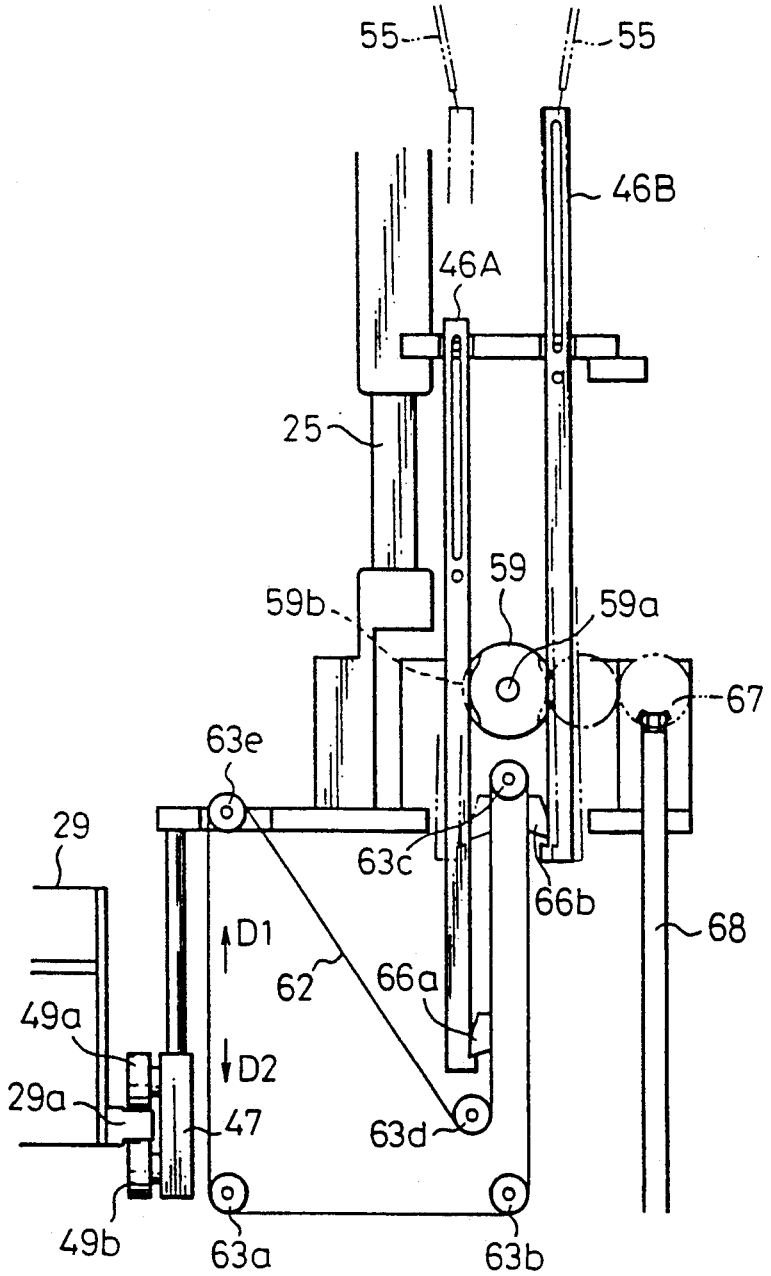

The third embodiment shown in FIG. 10 of the shed-forming mechanism is a modification of the above-mentioned first and second embodiments of the present invention. In this third embodiment, many machine elements having functions similar to those of the above-mentioned embodiments are utilized, and these machine elements are represented by the identical reference numerals to those of the above embodiments, and therefore, an explanation thereof is omitted.

As can be understood from the above-mentioned explanation of the first and second embodiments of the present invention, the space between two adjacent healds is relatively small, and thus in practice it is desirable to widen this space. Accordingly, in the third embodiment of the present invention, the space between two adjacent healds is enlarged to twice that of the above-mentioned first and second embodiments. Namely, in each unit shed-forming mechanism, the healds 46A, 46B are arranged in two alignments along respective horizontal circular arrangements, coaxially with each other as shown in FIG. 10. The arrangement of the healds 46A along the inside circular arrangement is hereinafter referred to as an inside arrangement, and the arrangement of the healds 46B along the outside circular arrangement is hereinafter referred to as an outside arrangement. Accordingly, a different mechanism for selectively creating the unit sheds when weaving a tubular fabric having a satin weave threads structure becomes necessary. Since the healds 46 of each unit shed-forming mechanism are arranged in two rows in the radial direction, the following technical concept is applied. Namely, one reciprocal upward and downward displacing motion of the holding member 47 is utilized to operate, separately and successively, a pair of healds 46A, 46B of the inside arrangement and the outside arrangement, so that, for example, when producing a tubular fabric having an eight healds satin weave structure, four plate cams 59 are utilized. Therefore, when utilizing the healds supporting mechanism as in the second embodiment, the cam plates 59 are arranged to rotate by a half revolution at each reciprocal upward and downward displacing motion, to displace one of the healds 46A of the inside arrangement to the bottom position at an identical level, or to displace one of the healds 46B of the outside arrangement to the bottom position at an identical level. To create the above-mentioned motion of the healds 46A, 46B, an endless belt 62 having a width equal to a space covering the motions of the healds 46A and 46B is arranged in such a manner that the endless belt 62 is guided by five guide rollers 63*a*, 63*b*, 63*c*, 63*d* and 63*e*, rotatably motioned on brackets (not shown) secured to the machine frame of the circular loom, while the endless belt 62 is connected to the holding member 47 so that the endless belt 62 is reciprocally moved towards an arrow D1 or an arrow D2 in accordance with the reciprocal upward and downward motion of the holding member 47. The endless belt 62 is provided with two groups of hook members 66*a*, 66*b* arranged in such a manner that each one of the hook members 66*a* can displace the corresponding heald 46A of the inside arrangement to the bottom position thereof when the hook member 66*a* is engaged with the hook portion 54 of the heald 46A, and each one of the hook members 66*b* can displace the corresponding heald 46B to the bottom position thereof when the hook member 66*b* is engaged with the hook portion 54 of the heald 46B. The above-mentioned engagement of the hook portion 54 to either one of the healds 46A, 46B is controlled by the motion of the cam plates 59, which act on the corresponding healds 46A, 46B in a manner similar to that of the cam plate 59 in the second embodiment, except that each cam plate 59 acts alternately on the corresponding heald 46A and 46B at each 180 degrees rotation thereof, as shown in FIG. 10. As explained with reference to the first embodiment of the present invention, each time a shed is formed to create one repeat weave structure, the shuttle 13 is inserted into the shed in accordance with the weave structure. Therefore, the arrangement of the hook members 66A and 66B is based on the principle explained with reference to the first embodiment. In the third embodiment, however, since two groups of healds, i.e., the healds 46A of the inside arrangement and the heald 46B of the outside arrangement, are used, the group hook members 66A are arranged against the respective hook portions 54 of the corresponding healds 46A of the inside arrangement, and the group hook members 66B are arranged against the respective hook portions 54 of the corresponding healds 46B. Further, since the endless belt 62 is moved in accordance with the reciprocal upward and downward displacement of the holding member 47, when the endless belt 62 is moved in the direction shown by an arrow D1 in FIG. 10, due to the upward displacement of &.he holding plate 47, the hook member 66A is able to engage with the hook portion 54 of one of the healds 46A, and when the endless belt 62 is moved in the direction of the arrow D2 in FIG. 10, due to the downward displacement of the holding member 47, the hook member 66B is able to engage with the hook portion 54 of one of the healds 46B. Since the arrangement of the hook members 66A and 66B can be made in the same manner as explained with reference to the first embodiment, while considering the above-mentioned mechanism having the double alignment of healds 46A and 46B as mentioned above, a detailed explanation thereof is omitted.

The mechanism explained with reference to the second embodiment can be used to drive the plate cams 59, but as shown in FIG. 10, a different mechanism can be applied. Namely, the cam plate 59 is rigidly mounted on a horizontal shaft 59*a* to which a pinion wheel 59*b* is secured, and the pinion wheel 59*b* is driven by a bevel gear mechanism 67 which is driven by a shaft 68, which, in turn, is synchronously driven by a main shaft of the circular loom via a power transmission mechanism (not shown) to insert one of the shuttles (when producing a tubular fabric having an eight healds satin weave structure, four shuttles are utilized).

As mentioned above, the tubular fabric having a satin weave structure can be also produced by applying the above-mentioned modifications of the shed-forming mechanism to the conventional circular loom, and thus the present invention contributes to an improvement of the quality of the tubular fabric, particularly for industrial use.

In the above description, the shed-forming mechanism is used particularly to produce a tubular fabric provided with a satin weave structure, and only the above-mentioned principle of forming sheds for creating a satin weave structure is disclosed. Nevertheless, this principle of forming a unit shed for creating a one repeat weave structure as mentioned above can be applied to the production of a tubular fabric having a weave structure other than a plain weave structure, such as a twill structure and other complicated plain weave structures.

I claim:

1. In a circular loom provided with a machine frame, a main drive shaft located at a central position of said machine frame in a vertical condition, a plurality of healds arranged in a ring-shaped alignment coaxially around said main driving shaft, an annular reed member stationarily located inside said ring-shaped alignment of said healds and coaxially thereto, means for supplying warps to said circular loom dispensed outside thereof, each of said healds being provided with an eye for threading said warp supplied from said supply means, an annular passaged defined by said annular reed member wherein shuttles are able to move along said annular passage, and a weft taken out from each of said shuttles in inserted into successive sheds created by a motion of said healds before the arrival of said shuttle thereat, and said weft is interwoven with warps to form a tubular fabric having a satin weave structure, means for moving each one of said shuttles along said annular passage, a shed-forming mechanism, comprising in combination with said main drive shaft;

a plurality of unit shed-forming mechanisms successively arranged at a position outside of said annular reed member and coaxially thereto, each unit shed-forming mechanism comprising a heald holding frame rigidly mounted on said annular reed member for displaceably guiding a group of said healds arranged in alignment along said ring-shaped alignment, a number of said group of healds being identical to a number of said healds forming a one repeat weave structure of said satin weave structure, each heald being provided with a hook portion formed at a bottom portion thereof and disposed to be displaced upward and downward within said heald holding frame, means for selectively catching said hook portion of one of said healds, based upon said one repeat weave structure of said satin weave structure, and a cylindrical cam means coaxially secured to said main drive shaft, wherein said means for selectively catching said hook portion of one of said healds comprises, a member for catching said hook portion of said heald, means for selectively actuating said catching member to catch said hook portion of one of said healds, based upon said one repeat weave structure of said predetermined weave structure, a member holding said selectively actuating means, means for supporting said holding member in a displaceable condition in a predetermined vertical direction upward and downward, said supporting means being rigidly mounted on said machine frame, said cylindrical cam means defining the upward and downward displacing motion of said holding means.

2. A circular loom according to claim 1, wherein said selectively actuating means comprises a control cylinder provided with a plurality of said catching members arranged thereon, number of said catching members being identical to a number of sheds for forming said one repeat wave structure, a shaft coaxially arranged thereto, a ratchet wheel mechanism secured to said shaft for turning said shaft by a predetermined rotation angle, said ratchet wheel mechanism being held in a casing secured to said holding member, and a member for actuating said ratchet wheel mechanism, a free end of said actuation member being protruded upward from said casing whereby, when said holding member is displaced upward and said free end of said actuation member is pressed downward by coming into contact with a solid part extended from a bottom portion of said annular reed member, said actuation member actuates said ratchet wheel mechanism so that said control cylinder is turned by a predetermined angle to create one she of said one repeat weave structure, said catching members arranged on said control cylinder in a condition that said catching members take respective angular positions whereat they are able to catch respective hook portions of the corresponding healds, based upon said one repeat weave structure, when said catching member is displaced to a position at which it can catch said hook portion, by a turning of said control cylinder.

3. A circular loom according to claim 1, wherein said unit shed-forming mechanism creates a bottom open shed at each shed formation, said means for selectively actuating said catching member to catch said hook portion of one of said healds is operated in cooperation with a motion of said healds, said catching member is a grooved portion formed in said holding member, each of said healds is provided with a slit formed at an upper portion thereof, said unit frame for supporting said healds as a group is provided with a plurality of horizontal arms secured to an upper surface of said annular reed member, each of said horizontal arms being provided with a horizontal shaft inserted to said slit of a corresponding one of said healds so that said healds are slidably and turnably supported by corresponding horizontal shafts, said means for selectively actuating said catching members comprising a plurality of plate cams provided with a shaft rotatably mounted on a bottom part of said annular reed member at a position at which one of said plate cams provided with a shaft rotatably mounted on a bottom part of said annular reed member at a position at which one of said plate cams is in contact with a corresponding one of said healds, means for driving said plate cams as a group for one rotation, a number of said plate cams being identical to said number of sheds for forming said one repeat weave structure, a plurality of spring means for always pushing said healds against a corresponding one of said plate cams, each of said plate cams being provided with a cam surface formed thereon, said cam surface being provided with a recessed portion, and said recessed portions of said cam plates being arranged relative to all of said cam plates in a condition such that said arrangement satisfies the distribution of said bottom shed based upon said one repeat wave structure at each one full rotation of said group of cam plates, said drive means being actuated by said main drive shaft such that each one of sheds for forming said one repeat weave structure is timely created for inserting said shuttle thereto, whereby when one of said plate cams takes an angular position at which said recessed portion of said cam surface is in contact with a corresponding one of said healds, a bottom portion of said healds is turned toward said holding member so that said hook portion of said heald is in a position at which can be engaged with said grooved portion of said holding member, and when said holding member is displaced downward, said heald is also displaced downward to form a bottom open shed, and said engagement is released when said holding member is displaced upward while said group of plate cams is also turned so that said heald is turned to a standby position for making said open bottom shed.

4. A circular loom according to claim 1, wherein said unit shed-forming mechanism creates a bottom opened shed at each shed formation, said means for selectively actuating said catching member to catch said hook portion of one of said healds is operated in accordance with a motion of said healds, said group of healds being divided into two groups having an identical number of healds arranged in two alignments coaxially along said annular reed member, each of said healds being provided with a slit formed at an upper portion thereof, said unit frame for supporting said healds is provided with a plurality of horizontal arms secured to an upper surface of said annular reed member, each of said horizontal arms being provided with a pair of horizontal shafts inserted to said slits of said healds of said inside alignment and said slits of said healds of said outside alignment, so that said healds are slidably supported by corresponding one of said horizontal shafts respectively, and means for selectively actuating said catching member comprising a plurality of plate cams provided with a common shaft rotatably mounted on a bottom part of said annular reed member at a position at which it comes into contact with side portions of one of said plate cams corresponding to one of said healds of said inside arrangement or corresponding to one of said healds of said outside alignment, said catching member comprises a pair of catching elements for acting on one of said hooks of said healds of said inside alignment and one of said hooks of said healds of said outside alignment, an endless belt connected to a portion of said holding member and five guide rollers rotatably mounted on said machine frame, said catching elements being arranged such that said arrangement satisfies the distribution of said bottom shed based upon said one repeat weave structure at each half round rotation of said group of plate cams, means for driving said common shaft of said plate cams by a 180 degrees rotation at each time said bottom open shed is formed, a number of said plate cams being a half of the number of sheds for forming said one repeat weave structure, said healds of said inside alignment and said healds of said outside alignment being always pressed against a corresponding one of said plate cams having a cam surface formed thereon, said cam surface being provided with a pair of recessed portions arranged in opposite positions with respect to the axial center thereof, said recessed portions of said plate cams being relatively arranged with respect to all of said plate cams and said arrangements of said healds, such that said arrangement of said recessed portions of said plate cams satisfies the distribution of said bottom sheds based upon one repeat weave structure at each a half round rotation of said common shaft of said plate cams, said drive means being actuated by said main drive shaft such that each one of said sheds for forming said one repeat weave structure is timely created for inserting said shuttle thereinto, whereby when one of said plate cams takes an angular position at which either one of said recessed portions thereof is in contact with a corresponding one of said healds of said two alignments, the bottom portion of said heald is turned toward a corresponding one of said catching elements of said endless belt so that said hook portion of said turned heald is able to be engaged with said catching elements, accordingly, said turned healds is displaced downward by the downward displacement of said catching element actuated by said holding member.

* * * * *

UNITED STATES PATENT AND TRADEMARK OFFICE

CERTIFICATE OF CORRECTION

PATENT NO. : 5,099,891

DATED : March 31, 1992

INVENTOR(S) : Satoru Hiramatsu

It is certified that error appears in the above-indentified patent and that said Letters Patent is hereby corrected as shown below:

The sheet of drawing consisting of Sheet 7 of 8, Fig. 7 delete and replace with the following Figures 8 and 9 as shown on the attached pages.

Signed and Sealed this

Seventh Day of December, 1993

Bruce Lehman

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,099,891

DATED : March 31, 1992

INVENTOR(S) : Satoru Hiramatsu

It is certified that error appears in the above-indentified patent and that said Letters Patent is hereby corrected as shown below:

Fig.8

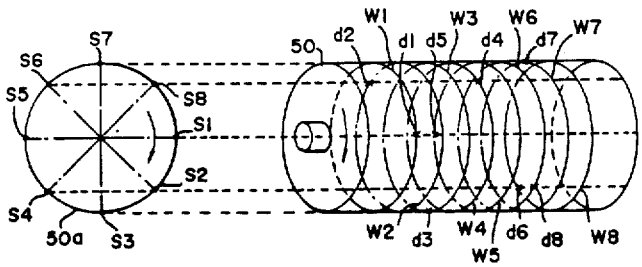

UNITED STATES PATENT AND TRADEMARK OFFICE

CERTIFICATE OF CORRECTION

PATENT NO. : 5,099,891

DATED : March 31, 1992

INVENTOR(S) : Satoru Hiramatsu

It is certified that error appears in the above-identified patent and that said Letters Patent is hereby corrected as shown below:

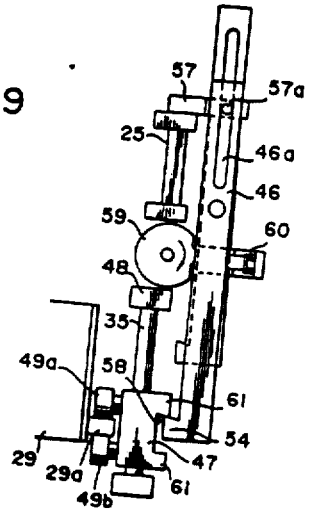

Fig.9